US006079857A

United States Patent [19]

Mendelsohn et al.

[11] Patent Number: 6,079,857

[45] Date of Patent: Jun. 27, 2000

[54] PIVOT CONNECTOR FOR EASEL LAMP

[76] Inventors: Fred M. Mendelsohn, 1214 W. Cass St., Tampa, Fla. 33606; Simon A. H. Lee, 316 Chungli City, Taoyuan Hsien, Taiwan

[21] Appl. No.: 09/236,530

[22] Filed: Jan. 25, 1999

[51] Int. Cl.[7] ..... F21V 14/02; A47G 1/24

[52] U.S. Cl. ..... 362/427; 362/287; 362/413; 362/419; 248/454

[58] Field of Search ..... 40/610; 248/441.4, 248/449, 454, 455, 456; 362/287, 413, 419, 422, 424, 427, 428, 457

[56] References Cited

U.S. PATENT DOCUMENTS

| | | | |
|---|---|---|---|
| 963,913 | 7/1910 | Lyhne | 362/413 |
| 1,360,531 | 11/1920 | Hyatt | 362/419 |
| 2,538,318 | 1/1951 | Mitchell | 248/455 |
| 2,732,481 | 1/1956 | King | 362/413 |
| 3,790,770 | 2/1974 | Stern | 362/413 |
| 4,300,300 | 11/1981 | Neuland et al. | 40/610 |
| 4,504,892 | 3/1985 | Zulfilar | 362/234 |
| 5,477,443 | 12/1995 | Cvek | 362/413 |
| 5,655,833 | 8/1997 | Raczynski | 362/419 |
| 5,884,888 | 3/1999 | Grimes, III et al. | 248/441.1 |

*Primary Examiner*—Alan Cariaso
*Attorney, Agent, or Firm*—A. W. Fisher, III

[57] ABSTRACT

A pivot connector for an easel lamp comprised of a fixing main body, a fixing bolt, a press bolt and a locking member; wherein, the fixing main body is provided with a pivot connecting recess adapted to be fixed at a suitable position on the easel, the fixing bolt is used to lock the pivot connector firm on the easel. The fixing main body is provided aside the fixing bolt with a through hole. The press bolt and the locking member are inserted respectively from the two ends of the through hole to connect with each other in the through hole. The locking member is provided on the end thereof with a toothed groove to be connected to a telescopically movable rod of a lamp receptacle. A lamp thereby can be firmly and pivotally connected on the pivot connector to get suitable illuminating position and distance above the easel.

3 Claims, 4 Drawing Sheets

PIVOT CONNECTOR FOR EASEL LAMP

BACKGROUND OF THE INVENTION

1. Field of the Invention

The present invention is related to a pivot connector for an easel lamp. The connector is movably mounted on any one of various easels for painting. With the connector, the distances and the angles of projection of light rays as well as the mounting location of the lamp can all be changed and adjusted. Hence with the connector, a painter can adjust the lamp by himself in pursuance of the brightness required to get the best illumination.

2. Description of the Prior Art

Generally in painting, in addition to the utensils of paint, drawing pens, drawing papers etc., other supplementary tools such as lamps, easels, drawing boards etc. are also required. The lamps are especially essential tools in painting; this is because brightness of rays gives extremely large influence to visual sensing in painting.

For a painter, a drawing paper is adhered to a painting board before the later is placed on an easel. As to the illumination in need, due to the structure of the easel, ordinarily, a non-specific illumination lamp near the painter is used to afford the required illumination. For example, a floor lamp or a hanging lamp may be placed near an easel to give the required illumination. However, the lamp can not be located at a desired position that can afford adequate illumination required by the painter due to the fact that it is not a specific illumination lamp for painting. This makes ununiform distribution of light rays and thus quality of the painted picture is influenced.

Moreover, such non-specific lamps have a common problem, that is, the distances of illumination, directions and the angles of the light rays of the lamps can not be adjusted effectively and conveniently. This is inconvenient for painter during painting, and this is why there still is lack of a specific lamp for an easel in the markets. The motive of the present invention is exactly resided in this problem.

SUMMARY OF THE INVENTION

A design for a specific lamp for an easel must take into consideration the applicability of mounting the lamp on any of the easels obtained from markets. The easels can be various and including portable type, general type, specific type etc., an easel is good when it is applicable for any of the types. The pivot connector of the present invention for an easel lamp meets this requirement and can be mounted on any of various types of easels. With the present invention, a lamp can illuminate downwards, sidewards or in any angular direction. And more, when an easel of the present invention is put at a suitable position, it can be adjusted in the projection distance and angle of the light source. In view of this, the pivot connector of the present invention for an easel lamp is extremely practical and convenient for painters using easels.

The object of the present invention is to provide a pivot connector for an easel lamp capable of widely useful for various types of easels. Such a pivot connector can have the function of random adjustment for the location of the lamp receptacle (i.e., the position of the light source), the projection distances and angles of the light rays. And after adjustment, the pivot connector still keeps firmness; thereby it has the convenience as well as practicality of using and adjustment.

To achieve the above stated object, a user can easily lock the pivot connector for an easel lamp of the present invention (without a hand tool in mounting) on any of various types of easels by means of bolt locking, wherein a telescopically movable rod is connected on one end thereof with the pivot connector while on the other end with a lamp receptacle. By means of this, angles between the pivot connector and the telescopically movable rod and between the telescopically movable rod and the lamp receptacle in connecting can be randomly adjusted. And even the elongation of the telescopically movable rod can be randomly adjusted. All for the purpose of getting the function of adjustment in obtaining an ideal location, angular position and the projection distance of the lamp receptacle. In this way, a specific pivot connector for an easel lamp capable of adjustment in multiple directions and capable of hanging at any position can be provided.

The present invention will be apparent after reading the detailed description of the preferred embodiment thereof in reference to the accompanying drawings.

DETAILED DESCRIPTION OF THE PREFERRED EMBODIMENT

Figure 1:
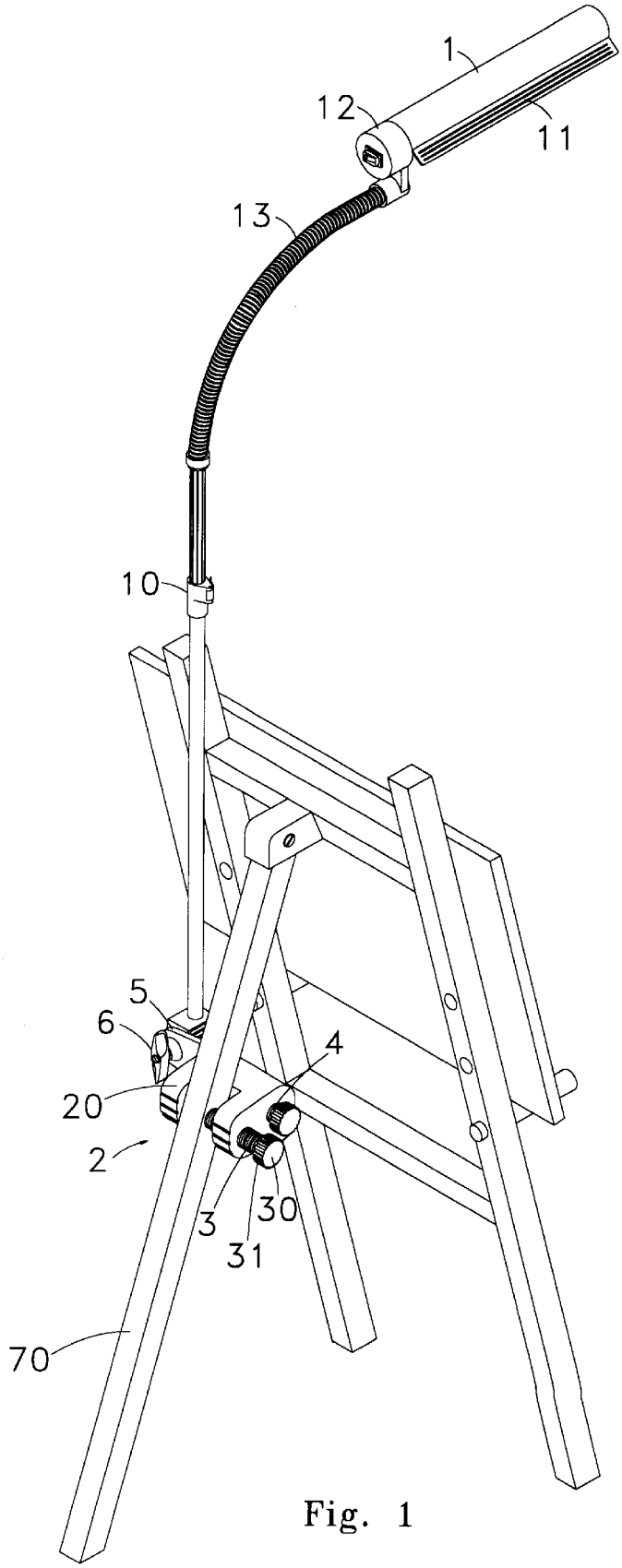
FIG. 1 is a perspective view of the present invention with a lamp on an easel.

Referring to FIG. 1, the present invention is used for general easels seen in the markets. The pivot connector of the present invention for an easel lamp is now described as below.

Figure 4:
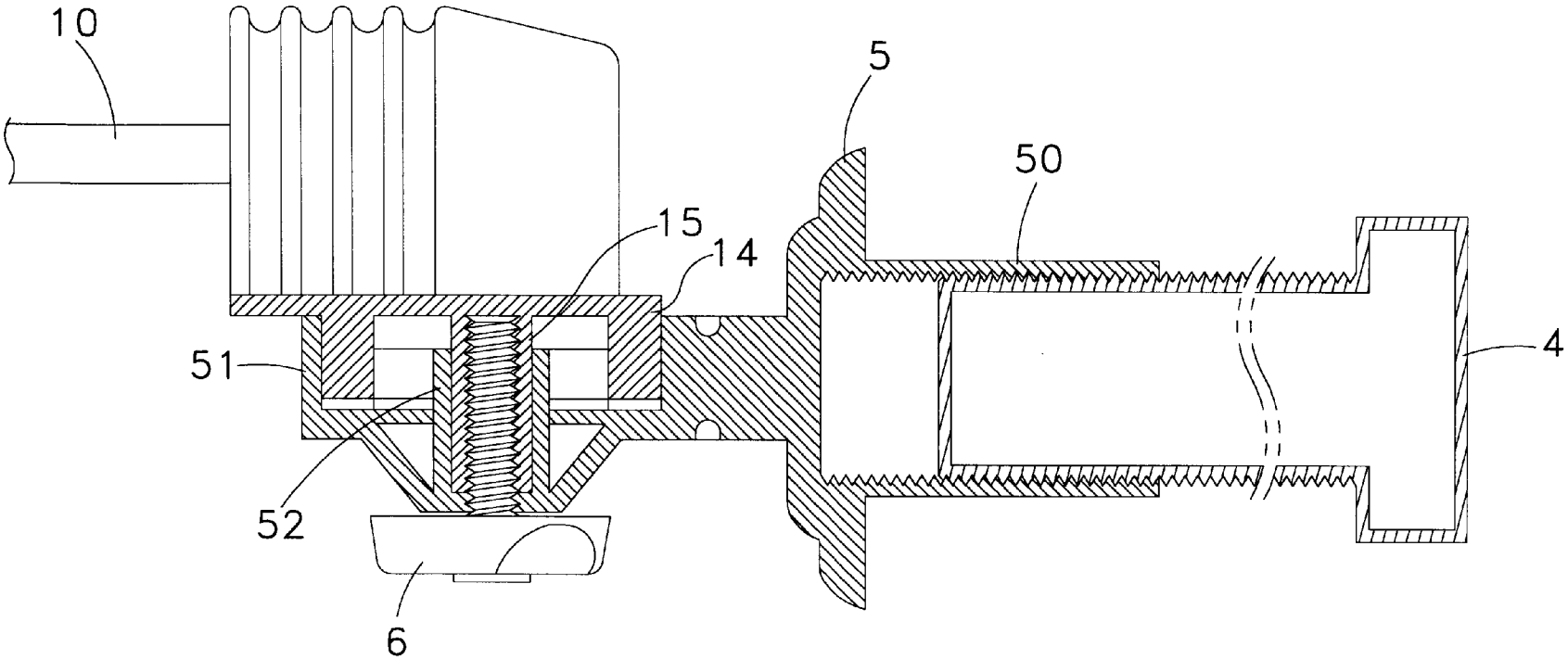
FIG. 4 is a sectional view showing engagement of the locking member and the telescopically movable rod of the present invention.

The present invention directs to a pivot connector 2 mounting on a post 70 of an easel 7; it is used to pivotably connect a telescopically movable rod 10 connected on one end thereof to a lamp receptacle 1 (FIG. 1), wherein:

The lamp receptacle 1 is provided on its two lateral sides opened for projecting light rays with two side wings 11 capable of adjustment of the projection angles and ranges of illumination. The lamp receptacle 1 is provided further on one end thereof with a cylindrical fixing portion 12 for connecting a hose 13 of which the other end is slipped over the telescopically movable rod 10. The hose 13 is made to be randomly adjustable in its angular direction, in order that it can be adjusted to correct the angles of illumination after the telescopically movable rod 10 has been adjusted and fixed for the projection distances of illumination. The other end of the telescopically movable rod 10 is provided with a toothed disk 14 and a connecting axle 15 to facilitate connection thereof to the pivot connector 2 (also referring to FIG. 4).

Figure 2:
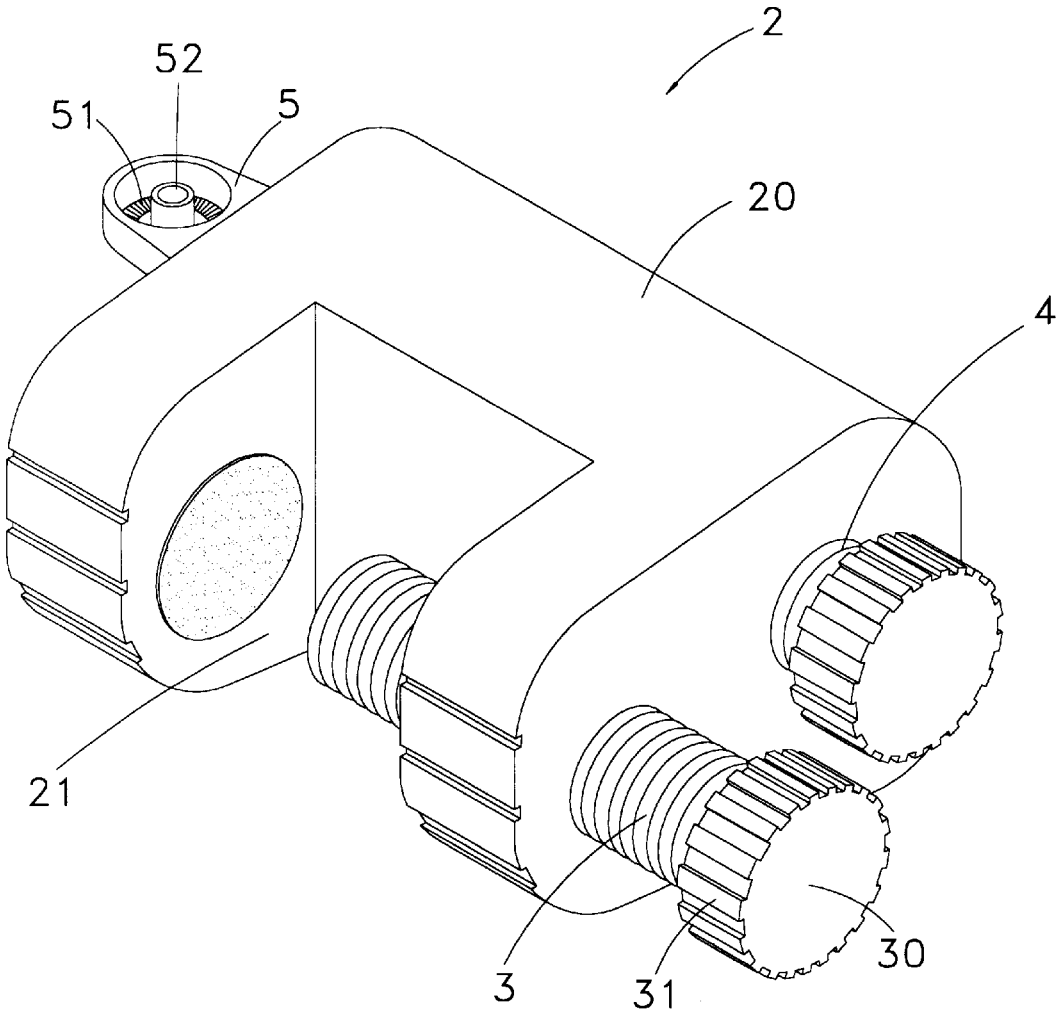
FIG. 2 is a perspective view of the pivot connector of the present invention.
Figure 3:
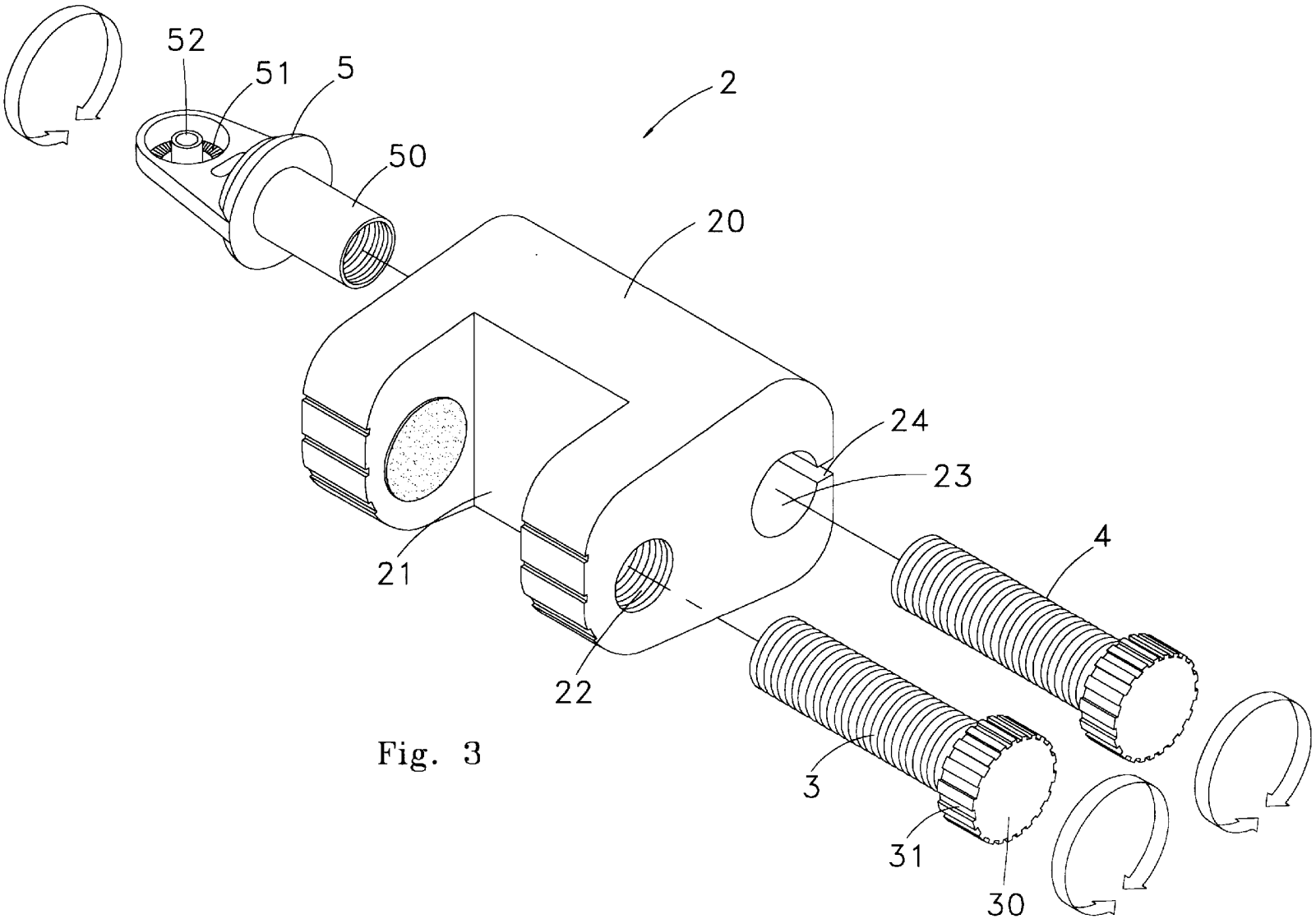
FIG. 3 is an analytic perspective view of the pivot connector of the present invention.

Referring to FIGS. 2 and 3, the pivot connector 2 of the present invention is comprised of a fixing main body 20, a fixing bolt 3, a press bolt 4 and a locking member 5, wherein:

The fixing main body 20 is provided at the middle thereof with a pivot connecting recess 21 of which the width is larger than that of the posts 70 of the easel 7. An inner thread 22 is provided in a hole on the wall of the pivot connecting recess 21 for screwing of the fixing bolt 3 therethrough. The head of the fixing bolt 3 is provided with an embossed annular surface 31 for a user to screw tight or loosen the fixing bolt 3 without a hand tool. The fixing main body 20 is further provided aside the fixing bolt 3 with a through hole 23 which is attached with a slit 24 to keep flexibility. The press bolt 4 and the locking member 5 are inserted from the two ends of the through hole 23 respectively. The press bolt 4 and the locking member 5 located on the two ends of the through hole 23 can be exchanged with each other for changing the position of the telescopically movable rod 10 connected to the lamp receptacle 1. The locking member 5 is provided on the end thereof with a locking cylinder 50. So that the locking member 5 can be locked on the press bolt 4 through the locking cylinder 50 after the locking member 5 is rotated for any angle relative to the through hole 23. The locking member 5 can be rotated to adjust the orientation of the telescopically movable rod 10 mounted thereon as well as connected to the lamp receptacle 1. The locking member 5 is provided further on the other end thereof with a toothed groove 51 having a connecting axle hole 52 therein. The toothed groove 51 and the connecting axle hole 52 are engaged with the above mentioned toothed disk 14 and connecting axle 15 on the telescopically movable rod 10. They are locked together with a locking member 6 (also referring to FIG. 4).

By means of the pivot connector 2 of the present invention, the pivot connecting recess 21 on the fixing main body 20 is adapted to be placed on any location on the posts 70 of the easel 7 and is locked with the fixing bolt 3. Further by the fact that the locking member 5 can be rotated for any angle and the telescopically movable rod 10 can be the telescopically moved, the present invention can be widely useful for various types of easels 7. Whereby, the function of random adjustment for the location of the lamp receptacle 1 (i.e., the position of the light source), the projection distances and angles of the light rays can be effected. The pivot connector of the present invention for an easel lamp therefore is extremely practical and convenient in mounting and adjustment.

Having thus described my invention, what I claim as new and desire to be secured by Letters Patent of the United States are:

1. A pivot connector for an easel comprised of a fixing main body, a fixing bolt, a press bolt and a locking member, wherein, said fixing main body is provided with a pivot connecting recess of which the width is larger than that of any post of said easel, an inner thread is provided on a hole on a wall of said pivoting connecting recess for screwing of said fixing bolt therethrough, thereby, said pivot connector is adapted to be fixed at a suitable position on said easel, said locking member of said pivot connector is adapted to be connected to a lamp receptacle, a lamp of said lamp receptacle thereby can be firmly and pivotally connected on said pivot connector; said pivot connector is characterized by:

said fixing main body is further provided aside said fixing bolt with a through hole, said press bolt and said locking member are inserted respectively from two opposite ends of said through hole, said locking member is provided on an end thereof with a locking cylinder and a toothed groove on the opposite end thereof, said locking cylinder is adapted to be inserted into said through hole on said fixing main body and rotated for any angle and then is pressed and locked with said press bolt, a lamp support of said lamp receptacle is connected to said toothed groove of said locking member.

2. A pivot connector for an easel lamp as stated in claim 1, wherein, said through hole on said fixing main body is provided with a slit.

3. A pivot connector for an easel lamp as stated in claim 1, wherein, said press bolt and said locking member located on said two ends of said through hole can be exchanged with each other.

* * * * *